US006642200B1

(12) United States Patent
Zhang et al.

(10) Patent No.: US 6,642,200 B1
(45) Date of Patent: Nov. 4, 2003

(54) FABRIC MAINTENANCE COMPOSITIONS COMPRISING CERTAIN CATIONICALLY CHARGED FABRIC MAINTENANCE POLYMERS

(75) Inventors: Shulin Larry Zhang, West Chester, OH (US); Janet Sue Littig, Fairfield, OH (US); Neil James Gordon, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/914,525

(22) PCT Filed: Mar. 24, 2000

(86) PCT No.: PCT/US00/08030

§ 371 (c)(1),
(2), (4) Date: Aug. 29, 2001

(87) PCT Pub. No.: WO00/56848

PCT Pub. Date: Sep. 28, 2000

Related U.S. Application Data

(60) Provisional application No. 60/126,072, filed on Mar. 25, 1999.

(51) Int. Cl.[7] ..... C11D 1/62; C11D 3/28; C11D 3/30; C11D 3/37

(52) U.S. Cl. ..... 510/475; 510/330; 510/335; 510/350; 510/360; 510/361; 510/384; 510/391; 510/434; 510/437; 510/476; 510/477; 510/480; 510/490; 510/500; 510/504

(58) Field of Search ..... 510/330, 335, 510/350, 360, 361, 384, 391, 434, 437, 475, 476, 477, 480, 490, 500, 504

(56) References Cited

U.S. PATENT DOCUMENTS

| | | | | | |
|---|---|---|---|---|---|
| 4,418,011 | A | * | 11/1983 | Bauman et al. | 252/544 |
| 5,783,533 | A | * | 7/1998 | Kensicher et al. | 510/119 |
| 6,525,013 | B1 | * | 2/2003 | Littig et al. | 510/322 |

FOREIGN PATENT DOCUMENTS

| | | | | | |
|---|---|---|---|---|---|
| DE | 19649288 | * | 6/1998 | | C11D/3/37 |
| EP | 754748 | * | 1/1997 | | C11D/3/00 |
| EP | WO 99/05248 | * | 2/1999 | | C11D/3/00 |
| EP | WO 00/22077 | * | 4/2000 | | C11D/3/37 |
| EP | WO 00/56848 | * | 9/2000 | | C11D/3/00 |
| GB | 2104091 | * | 3/1983 | | C11D/3/37 |
| JP | 61031499 A | * | 2/1986 | | C11D/1/38 |

* cited by examiner

*Primary Examiner*—Yogendra N. Gupta
*Assistant Examiner*—Brian P. Mruk
(74) *Attorney, Agent, or Firm*—Laura R. Grunzinger; Richard S. Echler; Kim William Zerby

(57) ABSTRACT

A composition comprising A) from about 0.1% by weight of a polymer, copolymer, or mixtures thereof, said polymer or copolymer comprising one or more monomers having a cationic group and which is capable of attenuating and/or abating the loss of fabric dye; and B) the balance carriers and adjunct ingredients.

9 Claims, No Drawings

FABRIC MAINTENANCE COMPOSITIONS COMPRISING CERTAIN CATIONICALLY CHARGED FABRIC MAINTENANCE POLYMERS

This application claims the benefit of U.S. Provisional Application Ser. No. 60/126,072 filed Mar. 25, 1999.

FIELD OF THE INVENTION

The present invention relates to fabric dye maintenance compositions which comprise one or more dye maintenance compounds which can be oligomers, polymers, co-polymers, and the like which comprise one or more monomers which results in the final dye maintenance compound having a net positive charge. Compositions comprising the dye maintenance polymers of this invention impart appearance and integrity benefits to fabrics and textiles treated with solutions formed from such compositions.

BACKGROUND OF THE INVENTION

It is, of course, well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to fabric treatment products, specifically to rinse added fabric conditioners, pre-wash spray on compositions, pre-soak compositions as well as after wash or between wash malodor control or fabric re-freshening compositions, materials which would associate themselves with the fibers of the fabrics and textiles thereby reducing, abating, or minimizing the tendency of the fabric/textiles to deteriorate in appearance. Any such fabric treatment/fabric maintenance composition additive material should, of course, be able to benefit fabric appearance and integrity without unduly interfering with the ability of the balance of laundry products to perform their intended function. The present invention is directed to the use of dye maintenance polymers in fabric treatment and fabric enhancement compositions which perform in this desired manner.

SUMMARY OF THE INVENTION

The present invention meets the aforementioned need in that it has been surprisingly discovered that fabric which is treated, and subsequently re-treated with the compositions of the present invention, will resist normal fading and color loss without regard to the circumstances, inter alia, due to mechanical wear and abrasion. In addition, fabric which has not been treated can have the loss of fabric dye attenuated by adding the compositions of the present invention to the laundry cycle as an adjunct via pre-soak, rinse additive, etc. The compositions of the present invention can be added is any manner, inter alia, as part of a formulation or as a separate composition.

The first aspect of the present invention relates to compositions providing dye protection benefits to fabric comprising:

A) from about 0.05%, preferably for about 0.1%, more preferably from about 0.5%, most preferably from about 1% to about 10%, preferably to about 7%, more preferably to about 5% by weight, of a polymer, copolymer, or mixtures thereof, said polymer or copolymer comprising one or more units selected from the group consisting of:

I) linear polymer units having the formula:

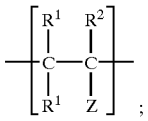

;

wherein each $R^1$ is independently
a) hydrogen;
b) $C_1$–$C_4$ alkyl;
c) substituted or unsubstituted phenyl;
d) substituted or unsubstituted benzyl;
e) carbocyclic;
f) heterocyclic;
g) and mixtures thereof;
each $R^2$ is independently
a) hydrogen;
b) halogen
c) $C_1$–$C_4$ alkyl;
d) $C_1$–$C_4$ alkoxy;
e) substituted or unsubstituted phenyl;
f) substituted or unsubstituted benzyl;
g) carbocyclic;
h) heterocyclic;
i) and mixtures thereof;
each Z is independently
a) hydrogen;
b) hydroxyl;
c) halogen;
d) $—(CH_2)_mR$;
wherein R is:
i) hydrogen;
ii) hydroxyl
iii) halogen;
iv) nitrilo;
v) $—OR^3$;
vi) $—O(CH_2)_nN(R)_2$;
vii) $—O(CH)N+(R^3)_3X^-$;
viii) $—OCO(CH_2)_nN(R^3)_2$;
ix) $—OCO(CH_2)_nN^+(R^3)_3X^-$;
x) $—NHCO(CH_2)_nN(R^3)_2$;
xi) $—NHCO(CH_2)_nN^+(R^3)_3X^-$;
xii) $—(CH_2)_nN(R^3)_2$;
xiii) $—(CH_2)_nN^+(R^3)_3X^-$;
xiv) carbocyclic;
xv) heterocyclic;
xvi) nitrogen heterocycle quaternary ammonium;
xvii) nitrogen heterocycle N-oxide;

xviii) aromatic N-heterocyclic quaternary ammonium;

xix) aromatic N-heterocyclic N-oxide;

xx) —NHCHO;

xxi) or mixtures thereof;

each $R^3$ is independently hydrogen, $C_1$–$C_8$ alkyl, $C_2$–$C_8$ hydroxyalkyl, and mixtures thereof; X is a water soluble anion;

the index n is from 0 to 6 e) $—(CH2)_mCOR'$ wherein R' is i) $—OR^3$;

ii) $—O(CH_2)_nN(R^3)_2$;

iii) $—O(CH_2)_nN^+(R^3)_3X^-$;

iv) $—NR^3(CH_2)_nN(R^3)_2$;

v) $—NR^3(CH_2)_nN^+(R^3)_3X^-$;

vi) $—(CH_2)_nN(R^3)_2$;

vii) $—(CH_2)_nN^+(R^3)_3X^-$;

viii) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6;

f) and mixtures thereof;

the index m is from 0 to 6;

II) cyclic units derived from cyclically polymerizing monomers having the formula:

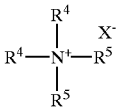

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion; and III) mixtures thereof;

provided said polymer or co-polymer has a net cationic charge; and

B) the balance carriers and other adjunct ingredients.

Another aspect of the present invention is the combination a dye protection composition and a fabric appearance composition to form a system form providing enhanced color and fabric fiber benefits to fabric comprising clothing and apparel, said dye protection system comprising:

A) from about 1% by weight, of a polymer or co-polymer comprising dye protection composition as described herein above; and B) from about 1% by weight, of a fabric enhancement composition, said composition providing one or more fabric enhancement benefits (fabric enhancement component); and C) the balance carriers and adjunct ingredients.

The present invention also relates to methods for preventing fading an loss of color to fabric comprising the step of contacting fabric with a composition according to the present invention or with a composition which comprises the components of the present invention as a color-care system.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to attenuation and/or abatement of fabric appearance loss. The compositions of the present invention comprise a cationic polymer or co-polymer which acts together with a low molecular weight fabric enhancement polyamine, fabric softness agent (crystal growth inhibitor) and dye fixing agent to provide protection to fabric from appearance loss which is primarily due to mechanical loss. Another aspect of the present invention relates to a composition which comprises a cationic polymer or co-polymer which acts together with a low molecular weight fabric enhancement polyamine, fabric softness agent (quaternary ammonium fabric softener active), dye fixing agent, and one further enhancement agent, inter alia, a stabilizer, co-solvent. Yet another aspect of the present invention relates to a composition which comprises a cationic polymer or co-polymer which acts together with a low molecular weight fabric enhancement polyamine, fabric softness agent (crystal growth inhibitor) and quaternary ammonium fabric softness agent, and dye fixing agent. The normal abrasive destruction of the fabric surface removes the surface layers of fabric which are dyed. Especially in the case of cotton fabric, below this layer of dyed fabric is the less dyed, then non-dyed fabric. As wears a "washed looked" develops which is due to the abrasive destruction of fabric and the subsequent loss of the weakened fabric fiber in the laundry cycle.

It has been surprisingly discovered that the combination of elements which comprise the compositions of the present invention modify the surface of fabric, especially cellulosic fabric and ameliorate many of the conditions which enhance fabric fiber surface wear and subsequent loss. The compositions of the present invention also soften the fabric surface making the fibers less abrasive and thereby reducing the level of friction between the fabric and surfaces in which the garment comes into contact. This change in surface condition can nullify many of the conditions which contribute to fabric damage and hence attenuate, and in some cases, abate fabric damage and therefore the concomitant loss of color.

The compositions of the present invention can be used for a stand alone treatment of fabric wherein the compositions are added as ingredients to a compatible fully formulated rinsed additive, laundry additive or pre-soak all of which are used together with fabric softeners, laundry detergent compositions and the like. The compositions of the present invention, either as a stand alone treatment or as a system, are suitable for providing a method for treating fabric and subsequently attenuating or abating the loss of color due to mechanical abrasion and removal of the top layer of dyed fabric.

Alternatively, the compositions comprise a fabric color integrity system. The systems of the present invention are used as an initial treatment of fabric by the manufacturer of either the fabric from which apparel is made or the fully formed article of manufacture (apparel). However, if the fabric is not pre-treated by the manufacturer, suitable protection is afforded to the fabric wherein the consumer applies the system to fabric during laundering. The systems of the present invention can be used at any point during the lifetime of apparel to abate the loss of color from fabric.

The following is a detailed description of the essential elements of the present invention.

Cationic Polymer or Co-polymer

Compositions and systems of the present invention comprise from about 0.05%, preferably for about 0.1%, more preferably from about 0.5%, most preferably from about 1% to about 10%, preferably to about 7%, more preferably to about 5% by weight, of a polymer, co-polymer, or mixture thereof, wherein said polymer or co-polymer comprises at least one cationically charged unit, inter alia, quaternary ammonium moiety or unit which can form a cationic charge in situ, inter alia, primary amine moiety.

I) Linear Polymer Units

The polymers or co-polymers of the present invention can comprise one or more linear polymer units having the formula:

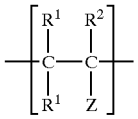

wherein $R^1$, $R^2$, and Z are defined herein below. Preferably, the linear polymer units are formed =from linearly polymerizing monomers. Linearly polymerizing monomers are defined herein as monomers which under standard polymerizing conditions result in a linear polymer chain or alternatively which linearly propagate polymerization. The linearly polymerizing monomers of the present invention have the formula:

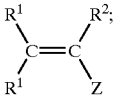

however, those of skill in the art recognize that many useful linear monomer units are introduced indirectly, inter alia, vinyl amine units, vinyl alcohol units, and not by way of linearly polymerizing monomers. For example, vinyl acetate monomers once incorporated into the backbone are hydrolyzed to form vinyl alcohol units. For the purposes of the present invention, linear polymer units may be directly introduced, i.e. via linearly polymerizing units, or indirectly, i.e. via a precursor as in the case of vinyl alcohol cited herein above.

Each $R^1$ is independently hydrogen, $C_1$–$C_4$ alkyl, substituted or unsubstituted phenyl, substituted or unsubstituted benzyl, carbocyclic, heterocyclic, and mixtures thereof. Preferably $R^1$ is hydrogen, $C_1$–$C_4$ alkyl, phenyl, and mixtures thereof, more preferably hydrogen and methyl.

Each $R^2$ is independently hydrogen, halogen, $C_1$–$C_4$ alkyl, $C_1$–$C_4$ alkoxy, substituted or unsubstituted phenyl, substituted or unsubstituted benzyl, carbocyclic, heterocyclic, and mixtures thereof. Preferred $R^2$ is hydrogen, $C_1$–$C_4$ alkyl, and mixtures thereof. Each Z is independently hydrogen; hydroxyl; halogen; —$(CH_2)_mR$, wherein R is hydrogen, hydroxyl, halogen, nitrilo, —$OR^3$, —$O(CH_2)_nN(R^3)_2$, —$O(CH_2)_nN^+(R^3)_3X^-$, —$OCO(CH_2)_nN(R^3)_2$, —$OCO(CH_2)_nN^+(R^3)_3X^-$, —$NHCO(CH_2)_nN(R^3)_2$, —$NHCO(CH_2)_nN^+(R^3)_3X^-$, —$(CH_2)_nN(R^3)_2$, —$(CH_2)_nN^+(R^3)_3X^-$, a non-aromatic nitrogen heterocycle comprising a quaternary ammonium ion, a non-aromatic nitrogen heterocycle comprising an N-oxide moiety, an aromatic nitrogen containing heterocyclic wherein one or more or the nitrogen atoms is quaternized; an aromatic nitrogen containing heterocycle wherein at least one nitrogen is an N-oxide; —NHCHO (formamide), or mixtures thereof; wherein each $R^3$ is independently hydrogen, $C_1$–$C_8$ alkyl, $C_2$–$C_8$ hydroxyalkyl, and mixtures thereof; X is a water soluble anion; the index n is from 0 to 6; carbocyclic, heterocyclic, or mixtures thereof, —$(CH_2)_mCOR'$ wherein R' is —$OR^3$, —$O(CH_2)_nN(R^3)_2$, —$O(CH_2)_nN^+(R^3)_3X^-$, —$NR^3(CH_2)_nN(R^3)_2$, —$NR^3(CH_2)_nN^+(R^3)_3X^-$, —$(CH_2)_nN(R^3)_2$, —$(CH_2)_nN^+(R^3)_3X^-$, or mixtures thereof, wherein $R^3$, X, and n are the same as defined herein above. A preferred Z is —$O(CH_2)_nN^+N(R^3)_3X^-$, wherein the index n is 2 to 4. The index m is from 0 to 6, preferably 0 to 2, more preferably 0.

Non-limiting examples of linearly polymerizing monomers comprising a heterocyclic Z unit includes 1-vinyl-2-pyrrolidinone, 1-vinylimidazole, 2-vinyl-1,3-dioxolane, 4-vinyl-1-cyclohexene1,2-epoxide, and 2-vinylpyridine.

The polymers and co-polymers of the present invention comprise Z units which have a cationic charge or which result in a unit which forms a cationic charge in situ. When the co-polymers of the present invention comprise more than one Z unit, for example, $Z^1$, $Z^2$, . . . $Z^n$ units, at least about 1% of the monomers which comprise the co-polymers will comprise a cationic unit. Preferred cationic units include —$O(CH_2)_nN^+(R^3)_3X^-$and —$(CH_2)_nN^+(R^3)_3X^-$. When the co-polymers of the present invention are formed from two monomers, $Z^1$ and $Z^2$, the ratio of $Z^1$ to $Z^2$ is preferably from about 9:1 to about 1:9.

A non-limiting example of an indirect Z unit which can be made to form a cationic charge in situ is the —NHCHO unit, formamide. The formulator can prepare a polymer or co-polymer comprising formamide units some of which are subsequently hydrolyzed to form vinyl amine equivalents. For example the formulator may prepare a co-polymer having the general formula:

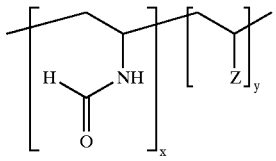

which comprises a formamide unit and then subsequently treat the co-polymer such that some of the formamide units are hydrolyzed to form a co-polymer comprising vinyl amine units, said polymer having the formula:

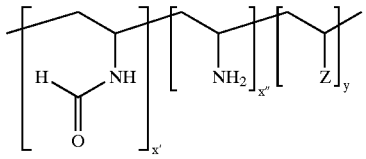

wherein Z may be a cationic unit comprising or non-cationic unit comprising moiety and x'+x"=x.

Another class of preferred linearly polymerizable monomers comprise cationically charged heteroaromatic Z units having the formula:

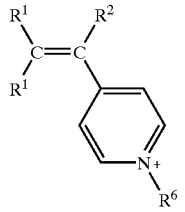

an non-limiting example of which is 4-vinyl (N-alkyl) pyridine wherein $R^1$ and $R^2$ are each hydrogen and $R^6$ is methyl.

Another class of preferred linearly polymerizable monomers which comprises a heterocyclic ring includes Z units comprising an N-oxide, for example, the N-oxide having the formula:

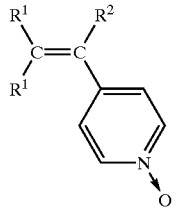

a non-limiting example of which is 4-vinyl pyridine N-oxide.

N-alkyl vinylpyridine monomers and N-oxide vinylpyridine monomers can be suitably combined with other non aromatic monomers, inter alia, vinyl amine. However, preferred polymers of the present invention include co-polymers derived from a combination of quaternized, N-oxide, and nitrogen containing heteroaromatic monomers, non-limiting examples of which includes a copolymer of N-methyl vinyl pyridine and vinyl pyridine in a ratio of 4:1; a copolymer of N-methyl vinyl pyridine and vinyl pyridine in a ratio of 4:6; a co-polymer of poly(N-methyl vinyl pyridine) and vinyl pyridine N-oxide in a ratio of polymer to monomer of 4:1; poly(N-methyl vinyl pyridine) and vinyl pyridine N-oxide in a ratio of polymer to monomer of 4:6; and mixtures thereof.

A preferred linear copolymer according to the present has the formula:

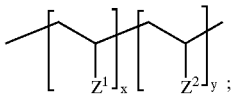

wherein $Z^1$ has the formula

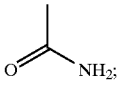

$Z^2$ has the formula:

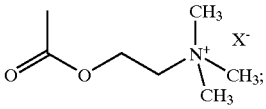

wherein X is chlorine; x has the value of from about 10 to about 100,000; y has the value of from about 10 to about 100,000; the ratio of x to y is from 9:1 to 1:9. Co-polymers of this type are available as, e.g., Sedipur® CF104 ex BASF.

As described herein above, some preferred polymer residues may be formed by treatment of the resulting polymer. For example, vinyl amine residues are preferably introduced via formamide monomers which are subsequently hydrolyzed to the free amino unit. Also vinyl alcohol units are obtained by hydrolysis of residues formed form vinyl acetate monomers. Likewise, acrylic acid residues may be esterified after polymerization, for example, units having the formula:

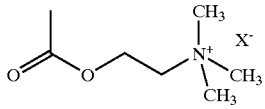

may be more conveniently formed after the backbone has been formed by polymerization with acrylic acid or acrylic acid precursor monomers.

II) Cyclic Units Derived from Cyclically Polymerizing Monomers

The polymers or co-polymers of the present invention can comprise one or more cyclic polymer units which are derived from cyclically polymerizing monomers. Cyclically polymerizing monomers are defined herein as monomers which under standard polymerizing conditions result in a cyclic polymer residue as well as serving to linearly propagate polymerization. Preferred cyclically polymerizing monomers of the present invention have the formula:

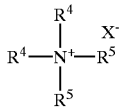

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion.

Non-limiting examples of $R^4$ units include allyl and alkyl substituted allyl units. Preferably the resulting cyclic residue is a six-member ring comprising a quaternary nitrogen atom.

$R^5$ is preferably $C_1$–$C_4$ alkyl, preferably methyl.

An example of a cyclically polymerizing monomer which results in a cyclic polymer unit is dimethyldiallyl ammonium having the formula:

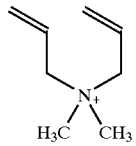

which results in a polymer or co-polymer having units with the formula:

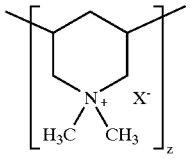

wherein preferably the index z is from about 10 to about 50,000.

III) Mixtures Thereof

The polymers or co-polymers of the present invention must retain a net cationic charge, whether the charged is developed in situ, or whether the polymer or co-polymer itself has a formal positive charge. Preferably the polymer or co-polymer has at least 10%, more preferably at least about 25%, more preferably at least about 35%, most preferably at least about 50% of the residues comprise a cationic charge.

The polymers or co-polymers of the present invention can comprise mixtures of linearly and cyclically polymerizing monomers, for example the poly(dimethyldiallylammonium chloride/acrylamide) co-polymer having the formula:

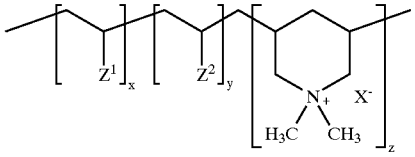

wherein $Z^1$, $Z^2$, x, y, and z are the same as defined herein above and X is chloride ion.

A particularly preferred embodiment of this invention is the composition comprising a polymer based on dimethyldiallylammonium chloride and a copolymer which is based upon acrylamide with a co-monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quaterized derivatives and mixtures thereof.

Non-limiting examples of preferred polymers according to the present invention include dye maintenance copolymers comprising:

i) a first monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quatemized derivatives and mixtures thereof; and ii) a second monomer selected from the group consisting of acrylic acid, methacrylic acid, $C_1$–$C_6$ alkylmethacrylate, $C_1$–$C_6$ alkyl acrylate, $C_1$–$C_8$ hydroxyalkylacrylate, $C_1$–$C_8$ hydroxyalkylmethacrylate, acrylamide, $C_1$–$C_{16}$ alkyl acrylamide, $C_1$–$C_{16}$ dialkylacrylamide, 2-acrylamido-2-methylpropane sulfonic acid or its alkali salt, methacrylamide, $C_1$–$C_{16}$ alkylmethacrylamide, $C_1$–$C_{16}$ dialkylmethacrylamide, vinyl formamide, vinylacetamide, vinyl alcohol, $C_1$–$C_8$ vinylalkylether, vinyl pyridine, itaconic acid, vinyl acetate, vinyl propionate, vinyl butyrate and mixtures thereof;

wherein the copolymer comprises at least 25 mole % of the first monomer.

Non-limiting examples of co-polymers which are highly effective in the embodiments of the present invention include co-polymer of acrylamide/dimethylamino ethylacrylate methochloride (molar ratio 24:1, K-value 85); co-polymer of polyacrylamides: acrylamide/dimethylamino ethylacrylate methochloride (molar ratio 9:1, K-value 70); co-polymer of acrylamide/dimethylamino ethylacrylate methochloride (molar ratio 9:1, K-value 60); co-polymer of acrylamide/dimethylamino ethylacrylate methochloride (molar ratio 49:1, K-value 60); and co-polymer of acrylamide/dimethylamino ethylacrylate methochloride (molar ratio 24/1, K-value 85).

CARE SYSTEMS

The present invention also relates to systems for providing enhanced care to fabric. The care systems according to the present invention comprise a composition providing dye protection benefits to fabric in combination with a separately added composition which provides a fabric enhancement benefit, said system comprising:

a) from about 0.05%, preferably for about 0.1%, more preferably from about 0.5%, most preferably from about 1% to about 10%, preferably to about 7%, more preferably to about 5% by weight, of a polymer or co-polymer comprising dye protection composition as described herein;

b) from about 0.01%, preferably from about 0.1% to about 20%, preferably to about 10% by weight, of a fabric abrasion reducing polymer, said fabric abrasion polymer comprising:

i) at least one monomeric unit comprising an amide moiety;

ii) at least one monomeric unit comprising an N-oxide moiety;

iii) and mixtures thereof;

c) optionally from about 1%, preferably from about 10%, more preferably from about 20% to about 80%, preferably to about 60%, more preferably to about 45% by weight of a quaternary ammonium fabric softening active, an amine derived therefrom, and mixtures thereof;

d) optionally less than about 15% by weight, of a principal solvent, preferably said principal solvent has a ClogP of from about 0.15 to about 1;

e) optionally from about 0.001% to about 90% by weight, of one or more dye fixing agents;

f) optionally from about 0.01% to about 50% by weight, of one or more cellulose reactive dye fixing agents;

g) optionally from about 0.01% to about 15% by weight, of a chlorine scavenger;

h) about 0.005% to about 1% by weight, of one or more crystal growth inhibitors;

i) optionally from about 1% to about 12% by weight, of one or more liquid carriers;

j) optionally from about 0.001% to about 1% by weight, of an enzyme;

k) optionally from about 0.01% to about 8% by weight, of a polyolefin emulsion or suspension;

l) optionally from about 0.01% to about 0.2% by weight, of a stabilizer;

m) optionally from about 1% to about 80% by weight, of a cationic surfactant;

n) from about 0.01% by weight, of one or more linear or cyclic polyamines which provide bleach protection; and o) the balance carrier and adjunct ingredients.

A non-limiting example of a preferred system according to the present invention comprises:

a) from about 0.05%, preferably from about 0.1%, more preferably from about 0.5%, most preferably from about 1% to about 10%, preferably to about 7%, more preferably to about 5% by weight, of a polymer or co-polymer comprising dye protection composition as described herein;

b) from about 0.01% to about 50% by weight, of a polyamine, said polyamine is selected from the group consisting of N,N'-bis(aminopropyl)-1,3-propylenediamine; N,N'-bis(hydroxyethyl)-N,N'-bis[3-N,N-bis(hydroxyethyl)aminopropyl]-1,3-propylenediamine; N,N'-bis(2-hydroxypropyl)-N,N'-bis[3-N,N-bis(2-hydroxypropyl)aminopropyl]-1,3-propylenediamine; N,N'-bis(2-hydroxybutyl)-N,N'-bis[3-N,N-bis(2-hydroxybutyl)aminopropyl]-1,3-propylenediamine; 5-N-methyldipropylenetriamine; 1,1-N-dimethyl-5-N'-methyl-9,9-N"-dimethyldipropylenetriamine; 1,1-N-dimethyl-9,9-N"-dimethyldipropylenetriamine; and mixtures thereof;

c) from about 0.005% to about 1% by weight, of one or more crystal growth inhibitors;

d) from about 0.001% to about 90% by weight, of one or more dye fixing agents; and e) the balance carriers and adjunct ingredients.

Another preferred system according to the present invention comprises:

a) from about 0.05%, preferably from about 0.1%, more preferably from about 0.5%, most preferably from about 1% to about 5%, preferably to about 3% by weight, of a polymer or co-polymer comprising dye protection composition as described herein;

b) from about 1%, preferably from about 10%, more preferably from about 20% to about 80%, preferably to about 60%, more preferably to about 45% by weight, of a quaternary ammonium fabric softening active, an amine derived therefrom, and mixtures thereof;

c) from about 0.01% to about 50% by weight, of a low molecular polyamine, said polyamine is selected from the group consisting of N,N'-bis(aminopropyl)-1,3-propylenediamine; N,N'-bis(hydroxyethyl)-N,N'-bis[3-N,N-bis(hydroxyethyl)aminopropyl]-1,3-propylenediamine; N,N'-bis(2-hydroxypropyl)-N,N'-bis[3-N,N-bis(2-hydroxypropyl)aminopropyl]-1,3-propylenediamine; N,N'-bis(2-hydroxybutyl)-N,N'-bis[3-N,N-bis(2-hydroxybutyl)aminopropyl]-1,3-propylenediamine; 5-N-methyl dipropylenetriamine; 1,1-N-dimethyl-5-N'-methyl-9,9-N"-dimethyl dipropylenetriamine; 1,1-N-dimethyl-9,9-N"-dimethyl dipropylenetriamine; and mixtures thereof;

d) from about 0.005% to about 1% by weight, of one or more crystal growth inhibitors; and e) the balance carriers and adjunct ingredients.

Low Molecular Weight Polyamines

The compositions of the present invention comprise from about 0.01%, preferably from about 0.75%, more preferably from 2%, to about 50%, preferably to about 35%, more preferably to about 20%, most preferably to about 15% by weight, of the herein described low molecular weight polyamines. In general, the polyamines are either linear polyamines or cyclic polyamines.

Linear Polyamines

The enhanced fabric appearance compositions of the present invention may comprise one or more polyalkyleneimines which have backbones comprising $C_2$–$C_6$ alkylene units, however, the backbones must comprise at least one $C_3$–$C_6$ alkylene unit, preferably the linear polyamines have each backbone unit comprising a $C_3$–$C_6$ alkylene unit.

The polyamines of the present invention have the formula:

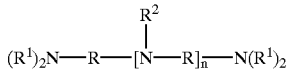

wherein each R is independently $C_2$–$C_6$ linear alkylene, $C_3$–$C_6$ branched alkylene, and mixtures thereof; preferably the backbone is a mixture of ethylene, 1,3-propylene, 1,3-propylene, 1,4-butylene, 1,6-hexylene, more preferably a mixture of ethylene and 1,3-propylene, most preferably the backbone comprises only 1,3-propylene units.

$R^1$ is hydrogen; $C_1$–$C_{12}$ alkyl, preferably $C_1$–$C_8$ alkyl, more preferably $C_1$–$C_4$alkyl; alkyleneoxy having the formula:

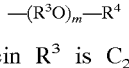

wherein $R^3$ is $C_2$–$C_6$ linear alkylene, $C_3$–$C_6$ branched alkylene, or mixtures thereof; preferably ethylene, mixtures of ethylene and 1,2-propylene, 1,2-butylene, preferably ethylene, 1,2-propylene. $R^4$ is hydrogen, $C_1$–$C_6$ alkyl, or mixtures thereof; preferably hydrogen or methyl, more preferably hydrogen. The index m is from 1 to 4, however, the value of m is predicated on the desired fabric enhancement benefit sought by the formulator. For example, the level of bleach protection varies over the value of m. Also, the dye fixation properties of the substantially linear polyamines are maximized when the alkyleneoxy unit is absent, i.e., $R^1$ and $R^2$ are hydrogen. $R^1$ is also acyl having the formula:

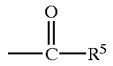

wherein $R^5$ is $C_1$–$C_2$, linear or branched alkyl, $C_3$–$C_{22}$ linear or branched alkenyl, or mixtures thereof; preferably $R^5$ is a hydrocarbyl moiety which sufficiently provides increased fabric lubricity, more preferably $C_6$–$C_{12}$ alkyl; hydroxy alkyl having the formula:

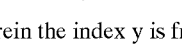

wherein the index y is from 1 to 5, z is from 1 to 3, provided y +z is less than or equal to 6 and the —(CHOH)— unit is not directly attached to a nitrogen atom. Non-limiting examples of hydroxy alkyl units include 2-hydroxy alkyl, for example, $—CH_2CHOHCH_3$, $—CH_2CHOHCH_2CH_2CH_2CH_3$. Two $R^1$ units can be taken together to form a 5–7 member ring, i.e., piperidine, morpholine. An example of a backbone wherein two $R^1$ units are taken together to form a ring has the formula:

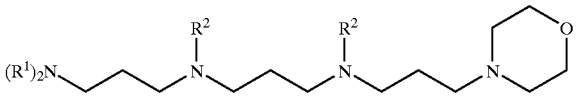

The present invention also includes mixtures of the herein described $R^1$ units.

$R^2$ is hydrogen, $R^1$, $—RN(R^1)_2$, and mixtures thereof. The integer n has the value from 1 or 6; preferably from 1 to 4, more preferably 1 or 3.

Most prefered linear polyamine has a backbone wherein R is 1,3-propylene and n is equal to 2, N,N'-bis(3-aminopropyl)-1,3-propylenediamine (TPTA). This preferred backbone can then be substituted or left unsubstituted in a manner which affords the formulator the maximal fabric benefit and compatibility of the low molecular weight amine with the particular embodiment. As a non-limiting example, when $R^1$ and $R^2$ are each equal to hydrogen, dye fixative properties, in certain liquid fabric care embodiments, even in the presence of bleach, are maximal. Also when $R^1$ and $R^2$ are not equal to hydrogen, bleach scavenging benefits are enhanced.

Those of ordinary skill in the art will recognize that depending upon the synthetic procedure used to prepare the polypropyleneamine backbones, varying amounts of both the linear and branched materials will be present in the final product admixture. The preferred backbones of the linear polyamines of the present invention comprise at least one 1,3-propylene unit, preferably at least two 1,3-propylene units.

For the purposes of the present invention, when a backbone nitrogen is referred to as "unmodified" the nitrogen contains only hydrogen atoms. "Modified" polyamines have one or more alkyleneoxy units as described herein above. Preferred substituents are methyl, 2-hydroxyethyl, 2-hydroxypropyl, 1,2-propyleneoxy, 2-hydroxybutyl, and mixtures thereof, more preferably methyl and 2-hydroxypropyl.

For certain formulations, polyamines which comprise alkylated polyamines are preferred, for example, tetramethyl dipropylenetriamine (1,1-N-dimethyl-9,9-N"-dimethyl dipropylenetriamine) having the formula:

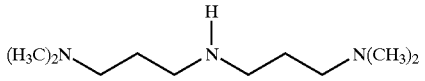

the permethylated dipropylenetriamine (1,1-N-dimethyl-5-N'-methyl-9,9-N"-dimethyl dipropylenetriamine) having the formula:

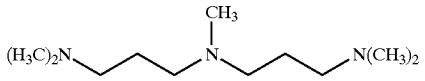

and the mono-methylated dipropylenetriamine (5-N'-methyl dipropylenetriamine) having the formula:

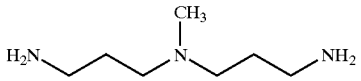

Cyclic Amines

The enhanced fabric appearance compositions of the present invention may comprise one or more cyclic polyalkyleneamines wherein at least one of the ring nitrogens is substituted with at least one $C_3$–$C_6$ alkyleneimine unit.

The low molecular weight cyclic polyamines of the present invention comprise polyamine backbones having the formula:

R—L—R wherein L is a linking unit, said linking unit comprising a ring having at least 2 nitrogen atoms; for example, 1,4-piperazine. R is hydrogen, $—(CH_2)_kN(R^1)_2$, and mixtures thereof, wherein at least one cyclic polyamine R unit is a $—(CH_2)kN(R')_2$ unit; preferably both R units are $—(CH_2)_kN(R^1)_2$; wherein each index k independently has the value from 3 to 12, preferably k is 3. Preferably the backbone of the cyclic amines including R units is 250 daltons or less. Most preferred backbone ring is 1,4-piperazine.

$R^1$ is hydrogen; $C_1$–$C_{12}$ alkyl, preferably $C_1$–$C_8$ alkyl, more preferably $C_1$–$C_4$ alkyl, most preferably methyl; alkyleneoxy having the formula:

$$—(R^3O)_m—R^4$$

wherein $R^3$ is $C_2$–$C_6$ linear alkylene, $C_3$–$C_6$ branched alkylene, or mixtures thereof; preferably ethylene, mixtures of ethylene and 1,2-propylene, 1,2-butylene, preferably ethylene, 1,2-propylene. $R^4$ is hydrogen, $C_1$–$C_6$ alkyl, or mixtures thereof; preferably hydrogen or methyl, more preferably hydrogen. The index m is from 1 to 4, however, the value of m is predicated on the desired fabric enhancement benefit sought by the formulator. For example, the level of bleach protection varies over the value of m. $R^1$ is also acyl having the formula:

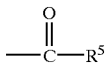

wherein $R^5$ is $C_1$–$C_{22}$ linear or branched alkyl, $C_3$–$C_{22}$ linear or branched alkenyl, or mixtures thereof; preferably $R^5$ is a hydrocarbyl moiety which sufficiently provides increased fabric lubricity, more preferably $C_6$–$C_{12}$ alkyl; hydroxy alkyl having the formula:

$$—(CH_2)_y(CHOH)_zH$$

wherein the index y is from 1 to 5, z is from 1 to 3, provided y +z is less than or equal to 6 and the —(CHOH)— unit is not directly attached to a nitrogen atom. Non-limiting examples of hydroxy alkyl units include 2-hydroxy alkyl, for example, $—CH_2CHOHCH_3$, $—CH_2CHOHCH_2CH_2CH_2CH_3$. Two $R^1$ units can be taken together to form a 5–7 member ring, i.e., piperidine, morpholine.

Preferably the backbone of the cyclic amines of the present invention comprise a NN'-bis-substituted 1,4-piperazine ring having the formula:

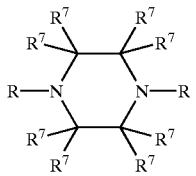

wherein each $R^7$ is independently hydrogen, $C_1$–$C_4$ alkyl, $C_1$–$C_4$ hydroxyalkyl, $C_1$–$C_4$ aminoalkyl, or two $R^7$ units of the same carbon atom are bonded to oxygen thus forming a carbonyl group (C═O) wherein the carbon atom is a ring atom, and mixture thereof. Examples of carbonyl containing rings which comprise L units are 1,4-diketopiperizines.

Preferably the backbones of the polyamines of the present invention, prior to modification, have the formula:

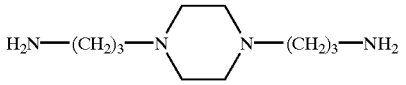

wherein each R unit is $CH_2)_3NH_2$.

However, the cyclic units may be substituted on only one ring nitrogen as in the case wherein one R unit is hydrogen, and the other R unit is $—(CH_2)_kNH_2$, for example, the piperazine having the formula:

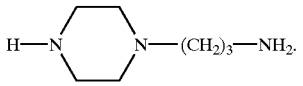

The backbones of the cyclic polyamines of the present invention preferably comprise at least one 1,3-propylene unit, more preferably at least two 1,3-propylene units.

For the purposes of the present invention, when a backbone nitrogen is referred to as "unmodified" the nitrogen contains only hydrogen atoms. "Modified" polyamines have one or more substituent units as described herein above. Preferably when the backbone units are modified all of the nitrogens are modified. Preferred alkyleneoxy substituents are ethyleneoxy, 1,2-propyleneoxy, and mixtures thereof, more preferably 1,2-propyleneoxy.

Crystal Growth Inhibitor

The compositions of the present invention optionally comprise from about 0.005%, preferably from about 0.5%, more preferably from about 0.1% to about 1%, preferably to about 0.5%, more preferably to about 0.25%, most preferably to about 0.2% by weight, of one or more crystal growth inhibitors. The following "Crystal Growth Inhibition Test" is used to determine the suitability of a material for use as a crystal growth inhibitor.

Crystal Growth Inhibition Test (CGIT)

The suitability of a material to serve as a crystal growth inhibitor according to the present invention can be determined by evaluating in vitro the growth rate of certain inorganic micro-crystals. The procedure of Nancollas et al., described in "Calcium Phosphate Nucleation and Growth in Solution", *Prog. Crystal Growth Charact.*, Vol 3, 77–102, (1980), incorporated herein by reference, is a method which is suitable for evaluating compounds for their crystal growth inhibition. The graph below serves as an example of a plot indicating the time delay (t-lag) in crystal formation afforded by a hypothetical crystal growth inhibitor.

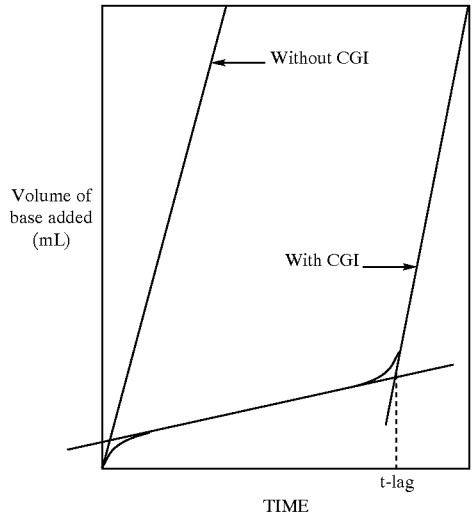

The observed t-lag provides a measure of the compound's efficiency with respect to delaying the growth of calcium phosphate crystal. The greater the t-lag, the more efficient the crystal growth inhibitor.

Exemplary Procedure

Combine in a suitable vessel, 2.1M KCl (35 mL), 0.0175M $CaCl_2$ (50 mL), 0.01M $KH_2PO_4$ (50 mL), and de-ionized water (350 mL). A standard pH electrode equipped with a Standard Calomel Reference electrode is inserted and the temperature adjusted to 37° C. while purging of the solution of oxygen. Once the temperature and pH are stabilized, a solution of the crystal growth inhibitor to be test is then added. A typical inhibitor test concentration is $1\times10^{-6}$M The solution is titrated to pH 7.4 with 0.05M KOH. The mixture is then treated with 5 mL's of a hydroxyapatite slurry. The hydroxyapatite slurry can be prepared by digesting Bio-Gel® HTP hydroxyapatite powder (100 g) in 1 L of distilled water the pH of which is adjusted to 2.5 by the addition of sufficient 6N HCl and subsequently heating the solution until all of the hydroxyapatite is dissolved (heating for several days may be necessary). The temperature of the solution is then maintained at about 22° C. while the pH is adjusted to 12 by the addition of a solution of 50% aqueous KOH. Once again the solution is heated and the resulting slurry is allowed to settle for two days before the supernatant is removed. 1.5 L of distilled water is added, the solution stirred, then after settling again for 2 days the supernatant is removed. This rinsing procedure is repeated six more time after which the pH of the solution is adjusted to neutrality using 2N HCl. The resulting slurry can be stored at 37° C. for eleven months.

Crystal growth inhibitors which are suitable for use in the present invention have a t-lag of at least 10 minutes, preferably at least 20 minutes, more preferably at least 50 minutes, at a concentration of $1\times10^{-6}$M. Crystal growth inhibitors are differentiated form chelating agents by the fact that crystal growth inhibitors have a low binding affmity of heavy metal ions, i.e., copper. For example, crystal growth inhibitors have an affinity for copper ions in a solution of 0.1 ionic strength when measured at 25° C., of less than 15, preferably less than 12.

The preferred crystal growth inhibitors of the present invention are selected from the group consisting of carboxylic compounds, organic diphosphonic acids, and mixtures thereof. The following are non-limiting examples of preferred crystal growth inhibitors.

Carboxylic Compounds

Non-limiting examples of carboxylic compounds which serve as crystal growth inhibitors include glycolic acid, phytic acid, polycarboxylic acids, polymers and co-polymers of carboxylic acids and polycarboxylic acids, and mixtures thereof. The inhibitors may be in the acid or salt form. Preferably the polycarboxylic acids comprise materials having at least two carboxylic acid radicals which are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. No. 3,128,287, U.S. Pat. No. 3,635,830, U.S. Pat. No. 4,663,071, U.S. Pat. No. 3,923,679; U.S. Pat. No. 3,835,163; U.S. Pat. No. 4,158,635; U.S. Pat. No. 4,120,874 and U.S. Pat. No. 4,102,903, each of which is included herein by reference.

Further suitable polycarboxylates include ether hydroxypolycarboxylates, polyacrylate polymers, copolymers of maleic anhydride and the ethylene ether or vinyl methyl ethers of acrylic acid. Copolymers of 1,3,5-trihydroxybenzene, 2,4,6-trisulphonic acid, and carboxymethyloxysuccinic acid are also useful. Alkali metal salts of polyacetic acids, for example, ethylenediamine tetraacetic acid and nitrilotriacetic acid, and the alkali metal salts of polycarboxylates, for example, mellitic acid, succinic acid, oxydisuccinic acid, polymaleic acid, benzene 1,3,5-tricarboxylic acid, carboxymethyloxysuccinic acid, are suitable for use in the present invention as crystal growth inhibitors.

The polymers and copolymers which are useful as crystal growth inhibitors have a molecular weight which is preferably greater than about 500 daltons to about 100,000 daltons, more preferably to about 50,000 daltons.

Examples of commercially available materials for use as crystal growth inhibitors include, polyacrylate polymers Good-Rite® ex BF Goodrich, Acrysol® ex Rohm & Haas, Sokalan® ex BASF, and Norasol® ex Norso Haas. Preferred are the Norasol® polyacrylate polymers, more preferred are Norasol® 410N (MW 10,000) and Norasol® 440N (MW 4000) which is an amino phosphonic acid modified polyacrylate polymer, and also more preferred is the acid form of this modified polymer sold as Norasol® QR 784 (MW 4000) ex Norso-Haas.

Polycarboxylate crystal growth inhibitors include citrates, e.g., citric acid and soluble salts thereof (particularly sodium salt), 3,3-dicarboxy-4-oxa-1,6-hexanedioates and related compounds further disclosed in U.S. Pat. No. 4,566,984 incorporated herein by reference, $C_5$–$C_{20}$ alkyl, $C_5$–$C_{20}$ alkenyl succinic acid and salts thereof, of which dodecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. No. 4,144,226, U.S. Pat. No. 3,308,067 and U.S. Pat. No. 3,723,322, all of which are incorporated herein by reference.

Organic Diphosphonic Acids

Organic diphosphonic acid are also suitable for use as crystal growth inhibitors. For the purposes of the present invention the term "organic diphosphonic acid" is defined as "an organo-diphosphonic acid or salt which does not comprise a nitrogen atom". Preferred organic diphosphonic acids include $C_1$–$C_4$ diphosphonic acid, preferably $C_2$ diphosphonic acid selected from the group consisting of ethylene diphosphonic acid, α-hydroxy-2phenyl ethyl diphosphonic acid, methylene diphosphonic acid, vinylidene-1,1-diphosphonic acid, 1,2-dihydroxyethane-1,1-diphosphonic acid, hydroxy-ethane-1,1-diphosphonic acid, the salts thereof, and mixtures thereof. More preferred is hydroxyethane-1,1-diphosphonic acid (HEDP).

Dye Fixing Agents

The compositions of the present invention optionally comprise from about 0.001%, preferably from about 0.5% to about 90%, preferably to about 50%, more preferably to about 10%, most preferably to about 5% by weight, of one or more dye fixing agents.

Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy. A preferred dye fixing agent for use in the compositions of the present invention is CARTAFIX CB® ex Clariant.

Other cationic dye fixing agents are described in "After-treatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines; derivatives of polymeric alkyldiamines, polyamine-cyanuric chloride condensates, and aminated glycerol dichlorohydrins are suitable for use as dye fixatives in the compositions of the present invention.

Cellulose Reactive Dye Fixing Agents

Another dye fixing agent suitable for use in the present invention are cellulose reactive dye fixing agents. The compositions of the present invention optionally comprise from about 0.01%, preferably from about 0.05%, more preferably from about 0.5% to about 50%, preferably to about 25%, more preferably to about 10% by weight, most preferably to about 5% by weight, of one or more cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator". The cellulose reactive dye fixing agents suitable for use in the present invention can be defined by the following test procedure.

Cellulose Reactivity Test (CRT)

Four pieces of fabric which are capable of bleeding their dye (e.g. 10×10 cm of knitted cotton dyed with Direct Red 80) are selected. Two swatches are used as a first control and a second control, respectively. The two remaining swatches are soaked for 20 minutes in an aqueous solution containing 1% (w/w) of the cellulose reactive dye fixing agent to be tested. The swatches are removed and thoroughly dried. One of the treated swatches which has been thoroughly dried, is passed ten times through an ironing calender which is adjusted to a "linen fabric" temperature setting. The first control swatch is also passed ten times through an ironing calender on the same temperature setting.

All four swatches (the two control swatches and the two treated swatches, one of each which has been treated by the ironing calender) are washed separately in Launder-C-Meter pots under typical conditions with a commercial detergent used at the recommended dosage for ½ hour at 60° C., followed by a thorough rinsing of 4 times 200 ml of cold water and subsequently line dried.

Color fastness is then measured by comparing the DE values of a new untreated swatch with the four swatches which have undergone the testing. DE values, the computed color difference, is defined in ASTM D2244. In general, DE values relate to the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space. For the purposes of the present invention, the lower the DE value for a sample, the closer the sample is to the un-tested sample and the greater the color fastness benefit.

As the test relates to selection or a cellulose reactive dye fixing agent, if the DE value for the swatch treated in the ironing step has a value which is better than the two control swatches, the candidate is a cellulose reactive dye fixing agent for the purposes of the invention.

Typically cellulose reactive dye fixing agents are compounds which contain a cellulose reactive moiety, non limiting examples of these compounds include halogenotriazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity. Preferred hydroxyethylene urea derivatives include dimethyloldihydroxyethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 ex Clariant, Zetex E ex Zeneca and Levogen BF ex Bayer. Preferred polycarboxylates derivatives include butane tetracarboxilic acid derivatives, citric acid derivatives, polyacrylates and derivatives thereof. A most preferred cellulosic reactive dye fixing agents is one of the hydroxyethylene urea derivatives class commercialized under the tradename of Indosol CR ex Clariant. Still other most preferred cellulosic reactive dye fixing agents are commercialized under the tradename Rewin DWR and Rewin WBS ex CHT R. Beitlich.

ADJUNCT INGREDIENTS

The compositions of the present invention may also optionally comprise one or more adjunct ingredients. Non-limiting examples of adjunct ingredients are selected from the group consisting of fabric softener actives, electrolytes, stabilizers, low molecular weight water soluble solvents including principal solvents, chelating agents, cationic charge boosters, dispersibility aids, soil release agents, non-ionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, ftmgicides, anti-corrosion agents, antifoam agents, and mixtures thereof.

Fabric Softening Actives

The compositions of the present invention optionally comprise at least about 1%, preferably from about 10%, more preferably from about 20% to about 80%, more preferably to about 60%, most preferably to about 45% by weight, of the composition of one or more fabric softener actives.

The preferred fabric softening actives according to the present invention are amines from which cationic fabric softener actives are derived having the formula:

$$(R)_{3-m}—N—[(CH_2)_n—Q—R^1]_m,$$

quatemary ammonium compounds having the formula:

$$[(R)_{4-m}—\overset{+}{N}—[(CH_2)_n—Q—R^1]_m]\ X^-,$$

and mixtures thereof, wherein each R is independently $C_1$–$C_6$ alkyl, $C_1$ -$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

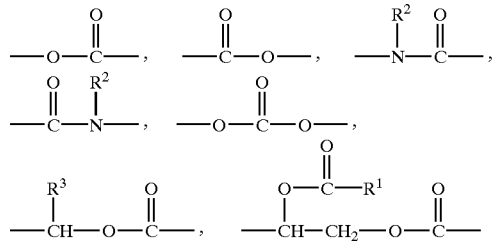

wherein $R^2$ is hydrogen, $C_1$–$C_4$ alky, preferably hydrogen; $R^3$ is $C_1$–$C_4$ alkyl, preferably hydrogen or methyl; preferably Q has the formula:

$$-O-\overset{O}{\overset{\|}{C}}- \quad \text{or} \quad -NH-\overset{O}{\overset{\|}{C}}-;$$

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case X(−) represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amine.

More preferred softener actives according to the present invention have the formula:

$$\left[(R)_{4-m}-\overset{+}{N}-\left[(CH_2)_n-O-\overset{O}{\overset{\|}{C}}-R^1\right]_m\right] X^-$$

wherein the unit having the formula:

$$-O-\overset{O}{\overset{\|}{C}}-R^1$$

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil. Yet more preferred are the Diester Quaternary Ammonium Compounds (DEQA's) wherein the index in is equal to 2.

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

$$[(R)_{4-m}-\overset{+}{N}-[(CH_2)_n-Q-R^1]_m] \quad X^-$$

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed. A further preferred embodiment of the present invention comprises DEQA's wherein the average Iodine Value for $R^1$ is approximately 45.

The $R^1$ units suitable for use in the isotropic liquids present invention can be further characterized in that the Iodine Value (IV) of the parent fatty acid, said IV is preferably from about 10, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active.

A prefered source of fatty acyl units, especially fatty acyl units having branching, for example, "Guerbet branching", methyl, ethyl, etc. units substituted along the primary alkyl chain, synthetic sources of fatty acyl units are also suitable. For example, the formulator may with to add one or more fatty acyl units having a methyl branch at a "non-naturally occuring" position, for example, at the third carbon of a $C_{17}$ chain. What is meant herein by the term "non-naturally occuring" is "acyl units which are not found in significant (greater than about 0.1%) quantities is common fats and oils which serve as feedstocks for the source of triglycerides described herein." If the desired branched chain fatty acyl unit is unavailable from readily available natural feedstocks, therefore, synthetic fatty acid can be suitably admixed with other synthetic materials or with other natural triglyceride derived sources of acyl units.

The following are examples of preferred softener actives according to the present invention.

- N,N-di(tallowyl-oxy-ethyl)-N,N-dimethyl ammonium chloride;
- N,N-di(canolyl-oxy-ethyl)-N,N-dimethyl ammonium chloride;
- N,N-di(tallowyl-oxy-ethyl)N-methyl, N-(2-hydroxyethyl) ammonium methyl sulfate;
- N,N-di(canolyl-oxy-ethyl)-N-methyl, N-(2-hydroxyethyl) ammonium methyl sulfate;

N,N-di(tallowylamidoethyl)-N-methyl, N-(2-hydroxyethyl) ammonium methyl sulfate;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride;

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tri(canolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dimethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bemadino, issued May 6, 1975; U.S. Pat. No. 3,861,870 Edwards et al., issued Jan. 21 1975; and European Patent Application publication No. 472,178, by Yamamura et al., all of said documents being incorporated herein by reference.

METHOD OF USE

The present invention further relates to methods for utilizing the systems and compositions of the present invention to abate and/or attenuate the loss of fabric color. One method according to the present invention comprises the step of contacting fabric which has been manufactured at a point wherein the fabric has not been worn or used, with a composition comprising:

A) from about 0.05%, preferably for about 0.1%, more preferably from about 0.5%, most preferably from about 1% to about 10%, preferably to about 7%, more preferably to about 5% by weight, of a polymer, copolymer, or mixtures thereof, said polymer or copolymer comprising one or more units selected from the group consisting of:

I) linear polymer units having the formula:

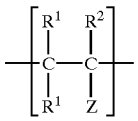

;

wherein each $R^1$ is independently a) hydrogen;

b) $C_1$–$C_4$ alkyl;

c) substituted or unsubstituted phenyl;

d) substituted or unsubstituted benzyl;

e) carbocyclic;

f) heterocyclic;

g) and mixtures thereof;

each $R^2$ is independently a) hydrogen;

b) halogen c) $C_1$–$C_4$ alkyl;

d) $C_1$–$C_4$ alkoxy;

e) substituted or unsubstituted phenyl;

f) substituted or unsubstituted benzyl;

g) carbocyclic;

h) heterocyclic;

i) and mixtures thereof;

each Z is independently a) hydrogen;

b) hydroxyl;

c) halogen;

d) $—(CH_2)_mR$;

wherein R is: i) hydrogen; ii) hydroxyl iii) halogen;

iv) nitrilo;

v) $—OR^3$;

vi) $—O(CH_2)_nN(R^3)_2$;

vii) $—O(CH_2)_nN^+(R^3)_3X^-$;

viii) $—OCO(CH_2)_nN(R^3)_2$;

ix) $—OCO(CH_2)_nN^+(R^3)_3X^-$;

x) $—NHCO(CH_2)_nN(R^3)_2$;

xi) $—NHCO(CH_2)_nN^+(R^3)_3X^-$;

xii) $—(CH_2)_nN(R^3)_2$;

xiii) $—(CH_2)_nNW(R^3)_3X^-$;

xiv) carbocyclic;

xv) heterocyclic;

xvi) nitrogen heterocycle quaternary ammonium;

xvii) nitrogen heterocycle N-oxide;

xviii) aromatic N-heterocyclic quaternary ammonium;

xix) aromatic N-heterocyclic N-oxide;

xx) —NHCHO;

xxi) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6 e) $—(CH_2)_mCOR'$ wherein R' is i) $—OR^3$;

ii) $—O(CH_2)_nN(R^3)_2$;

iii) $—O(CH_2)_nN^+(R^3)_3X^-$;

iv) $—NR^3(CH_2)_nN(R^3)_2$;

v) $—NR^3(CH_2)_nN^+(R^3)_3X^-$;

vi) $—(CH_2)_nN(R^3)_2$;

vii) $—(CH_2)_nN^+(R^3)_3X^-$;

viii) or mixtures thereof;

each $R^3$ is independently hydrogen, $C_1$–$C_8$ alkyl, $C_2$–C8 hydroxyalkyl, and mixtures thereof; X is a water soluble anion; the index n is from 0 to 6;

f) and mixtures thereof; the index m is from 0 to 6;

II) cyclic units derived from cyclically polymerizing monomers having the formula:

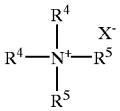

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion; and III) mixtures thereof;

provided said polymer or co-polymer has a net cationic charge;

B) from about 50% by weight, of a fabric enhancement component, said composition comprising:

a) from about 0.01%, preferably from about 0.1% to about 20%, preferably to about 10% by weight, of a fabric abrasion reducing polymer, said fabric abrasion polymer comprising:

i) at least one monomeric unit comprising an amide moiety;

ii) at least one monomeric unit comprising an N-oxide moiety;

iii) and mixtures thereof;

b) optionally from about 1%, preferably from about 10%, more preferably from about 20% to about 80%, preferably to about 60%, more preferably to about 45% by weight, of a quaternary ammonium fabric softening active, an amine derived therefrom, and mixtures thereof;

c) optionally less than about 15% by weight, of a principal solvent, preferably said principal solvent has a ClogP of from about 0.15 to about 1;

d) optionally from about 0.001% to about 90% by weight, of one or more dye fixing agents;

e) optionally from about 0.01% to about 50% by weight, of one or more cellulose reactive dye fixing agents;

f) optionally from about 0.01% to about 15% by weight, of a chlorine scavenger;

g) about 0.005% to about 1% by weight, of one or more crystal growth inhibitors;

h) optionally from about 1% to about 12% by weight, of one or more liquid carriers;

i) optionally from about 0.001% to about 1% by weight, of an enzyme;

j) optionally from about 0.01% to about 8% by weight, of a polyolefin emulsion or suspension;

k) optionally from about 0.01% to about 0.2% by weight, of a stabilizer;

l) optionally from about 1% to about 80% by weight, of a cationic surfactant;

m) from about 0.01% by weight, of one or more linear or cyclic polyamines which provide bleach protection; and o) the balance carrier and adjunct ingredients.

A preferred fabric enhancement component according to the present invention comprises:

B) from about 0.01% to about 50% by weight, of a polyamine, said polyamine is selected from the group consisting of N,N'-bis(aminopropyl)-1,3-propylenediamine; N,N'-bis(hydroxyethyl)-N,N'-bis[3-N,N-bis(hydroxyethyl)aminopropyl]-1,3-propylenediamine; N,N'-bis(2-hydroxypropyl)-N,N'-bis[3-N,N-bis(2-hydroxypropyl)aminopropyl]-1,3-propylenediamine; N,N'-bis(2-hydroxybutyl)-N,N'-bis[3-N,N-bis(2-hydroxybutyl)aminopropyl]-1,3-propylenediamine; 5-N-methyl dipropylenetriamine; 1,1-N-dimethyl-5-N'-methyl-9,9-N"-dimethyl dipropylenetriamine; 1,1-N-dimethyl-9,9-N"-dimethyl dipropylenetriamine; and mixtures thereof;

C) from about 0.005% to about 1% by weight, of one or more crystal growth inhibitors;

D) from about 0.001% to about 90% by weight, of one or more dye fixing agents; and E) the balance carriers and adjunct ingredients.

A preferred usage regime consists of the pre-treating the garment, or the fabric from which it is derived, with a composition according to the present invention. This pre-treatment can be carried out by the manufacturer of the garment, or by the consumer. The pre-treatment can conveniently be carried out by the consumer during the pre-treatment or primary wash cycle of the domestic washing machine. In conjunction with the pre-treatment step the consumer may also use a co-composition as described herein which can suitably be added to the rinse cycle of the washing process. The co-composition can be optionally used every time that the garment is laundered. The compositions of the invention can be used to re-apply a pre-treatment to the garment on a periodic basis. The frequency of pre-applying the compositions of the present invention can be varied depending on the degree of color protection desired by the consumer. A typical re-application may commence after every 3 or 4 washing cycles to maintain a good level of color protection.

The following are non-limiting examples of the compositions of the present invention.

TABLE I

| | Weight % | | | |
|---|---|---|---|---|
| Ingredients | 1 | 2 | 3 | 4 |
| Cationic dye fixative[1] | 2.4 | — | 4.0 | — |
| Polymer[2] | — | 2.4 | — | 1.4 |
| Polyamine[3] | 8.0 | 8.0 | — | 6.0 |
| Anti-scaling agent[4] | 0.75 | — | — | 1.0 |
| Anti-scaling agent[5] | — | 1.0 | 0.75 | — |
| Cationic surfactant[6] | 1.0 | 2.0 | 3.5 | 1.0 |
| Polymer[7] | — | 5.0 | 1.0 | — |
| Polymer[8] | 1.0 | — | — | 1.0 |
| Polymer[9] | 5.0 | — | 4.0 | 5.0 |
| Perfume | 0.15 | 0.1 | 0.4 | 0.25 |
| Water | balance | balance | balance | balance |

[1]Dye fixing agent ex Clariant under the tradename Cartafix CB

[2]Polydimethyl-diallyl ammonium chloride

[3]N'-(3-(dimethylamino)propyl)-N,N-dimethylpropane-1,3-diamine

[4]Hydroxyethanediphosphonate

[5]Bayhibit AM ex Bayer

[6]Armosoft 12W ex Akzo-Nobel

[7]Polyvinylpyrrolidone K85 available ex BASF as Luviskol K85.

[8]Polyvinylpyrrolidone K15 available ex BASF as Luviskol K15

[9]Cationically modified polyacrylamides: acrylamide/dimethylamino ethylacrylate methochloride (molar ratio 24/1, K-value 85).

TABLE II

| Ingredients | Weight % | | | |
|---|---|---|---|---|
| | 5 | 6 | 7 | 8 |
| Cationic dye fixative[1] | 4.0 | 2.4 | 2.0 | 2.5 |
| Polyamine[2] | 3.0 | — | — | 1.5 |
| Polyamine[3] | — | 15.0 | 12.0 | 6.0 |
| Polymer[4] | 1.0 | — | — | 1.0 |
| Anti-scaling agent[5] | 0.75 | 1.0 | 0.75 | 1.0 |
| Cationic surfactant[6] | 2.0 | 0.5 | 3.0 | 2.5 |
| Polymer[7] | 1.0 | — | — | 1.0 |
| Polymer[8] | — | 1.0 | 1.0 | 1.0 |
| Polymer[9] | — | — | 2.0 | 5.0 |
| Polymer[10] | 5.0 | 3.5 | 3.0 | — |
| Perfume | 0.15 | 0.10 | 0.40 | 0.25 |
| Water | balance | balance | balance | balance |

[1]Dye fixing agent ex Clariant under the tradename Cartafix CB
[2]Lupasol SK ex BASF.
[3]1,4-bis(3-aminopropyl)piperizine.
[4]Imidazole/epichlorohydrin co-polymer.
[5]Hydroxyethanediphosphonate.
[6]Armosoft 12W ex Akzo-Nobel.
[7]Polyvinylpyrrolidone K85 available ex BASF as Luviskol K85.
[8]Polyvinylpyrrolidone K15 available ex BASF as Luviskol K15
[9]Cationically modified polyacrylamides: acrylamide/dimethylamino ethylacrylate methochloride (molar ratio 24:1, K-value 85).
[10]Cationically modified polyacrylamides: acrylamide/dimethylamino ethylacrylate methochloride (molar ratio 9:1, K-value 70).

TABLE III

| Ingredients | Weight % | | | |
|---|---|---|---|---|
| | 9 | 10 | 11 | 12 |
| Cationic dye fixative[1] | 2.4 | 2.0 | 4.0 | 5.0 |
| Polyamine[2] | — | 10.0 | — | 15.0 |
| Polyamine[3] | 8.0 | — | 12.0 | — |
| Anti-scaling agent[4] | 0.75 | — | — | 1.0 |
| Anti-scaling agent[5] | — | 1.0 | 0.75 | — |
| Cationic surfactant[6] | 2.0 | 1.5 | 3.5 | 4.0 |
| Polymer[7] | — | — | 1.0 | — |
| Polymer[8] | 1.0 | 1.0 | — | 1.0 |
| Polymer[9] | — | 3.5 | 3.0 | — |
| Polymer[10] | 5.0 | — | 3.0 | 5.0 |
| Perfume | 0.15 | 0.10 | 0.40 | 0.25 |
| Water | balance | balance | balance | balance |

[1]Dye fixing agent ex Clariant under the tradename Cartafix CB
[2]Permethylated dipropylenetriamine.
[3]N'-(3-(dimethylamino)propyl)-N,N-dimethylpropane-1,3-diamine.
[4]Hydroxyethanediphosphonate.
[5]Bayhibit AM ex Bayer.
[6]Armosoft 12W ex Akzo-Nobel.
[7]Polyvinylpyrrolidone K85 available ex BASF as Luviskol K85.
[8]Polyvinylpyrrolidone K15 available ex BASF as Luviskol K15
[9]Cationically modified polyacrylamides: acrylamide/dimethylamino ethylacrylate methochloride (molar ratio 9:1, K-value 60).
[10]Cationically modified polyacrylamides: acrylamide/dimethylamino ethylacrylate methochloride (molar ratio 49:1, K-value 60).

The following are non-limiting examples of clear, colorless isotropic liquid embodiments of the present invention.

TABLE IV

| Ingredients | Weight % | | | |
|---|---|---|---|---|
| | 13 | 14 | 15 | 16 |
| Fabric softener active[1] | 30.0 | 30.0 | 45.0 | 45.0 |
| Ethanol[2] | 2.5 | 2.5 | 3.7 | 3.7 |
| Hexylene glycol[3] | 2.7 | 2.7 | 4.0 | 4.0 |
| Hexylene glycol[4] | 6.0 | 6.0 | — | 10.0 |
| Principal solvent[5] | — | — | 10.0 | — |
| Nonionic surfactant[6] | 4.5 | 4.5 | — | — |

TABLE IV-continued

| Ingredients | Weight % | | | |
|---|---|---|---|---|
| | 13 | 14 | 15 | 16 |
| Nonionic surfactant[7] | — | — | 2.6 | 2.6 |
| Polymer[8] | 1.0 | 1.0 | — | 1.0 |
| Polymer[9] | — | 3.5 | 3.0 | — |
| Polymer[10] | 5.0 | — | 3.0 | 5.0 |
| $CaCl_2$ | — | — | 0.75 | 0.75 |
| $MgCl_2$ | 1.5 | 1.5 | — | — |
| Chelant[11] | — | 0.2 | — | — |
| Chelant[12] | — | — | 0.2 | 0.2 |
| Ammonium chloride | 0.1 | 0.1 | — | — |
| Perfume | 2.5 | 2.5 | 2.5 | 2.5 |
| Water | balance | balance | balance | balance |

[1]N,N-di(canoyloxyethyl)-N-2-hydroxyethyl-N-methyl ammonium methyl sulfate available from Witco.
[2]Ethanol is present from the manufacturing process of the quaternary fabric softener active.
[3]Hexylene glycol is present from the manufacturing process of the quaternary fabric softener active.
[4]Added hexylene glycol.
[5]2,2,4-Trimethyl-1,3-pentanediol (TMPD).
[6]$C_9$–$C_{11}$ alkyl E8 alcohol available as Neodol ® 91-8 ex Shell.
[7]$C_{11}$–$C_{15}$ alkyl E9 alcohol available as Tergitol ® 15S9 ex Union Carbide.
[8]Polyvinylpyrrolidone K15 available ex BASF as Luviskol K15
[9]Cationically modified polyacrylamides: acrylamide/dimethylamino ethylacrylate methochloride (molar ratio 9:1, K-value 60).
[10]Cationically modified polyacrylamides: acrylamide/dimethylamino ethylacrylate methochloride (molar ratio 49:1, K-value 60).
[11]Diethylene triamine pentaacetate.
[12]Tetrakis-(2-hydroxypropyl)ethylenediamine.

TABLE V

| Ingredients | Weight % | | | |
|---|---|---|---|---|
| | 17 | 18 | 19 | 20 |
| Fabric softener active[1] | 30.0 | — | — | 45.0 |
| Fabric softener active[2] | — | 28.5 | — | — |
| Fabric softener active[3] | — | — | 30.0 | — |
| Ethanol[4] | 2.5 | 2.5 | 3.7 | 3.7 |
| Hexylene glycol[5] | 2.7 | 2.7 | 4.0 | 4.0 |
| Hexylene glycol[6] | 6.0 | 6.0 | — | — |
| Principal solvent[7] | — | — | 10.0 | 10.0 |
| Nonionic surfactant[8] | 4.5 | 4.5 | — | — |
| Nonionic surfactant[9] | — | — | 2.6 | 2.6 |
| Low molecular weight polyamine[10] | 1.0 | 1.1 | — | — |
| Low molecular weight polyamine[11] | — | — | 1.1 | — |
| Low molecular weight polyamine[12] | — | — | — | 1.1 |
| Polymer[13] | 1.0 | 1.0 | — | 1.0 |
| Polymer[14] | — | 3.5 | 3.0 | — |
| Polymer[15] | 5.0 | — | 3.0 | 5.0 |
| $CaCl_2$ | — | — | 0.75 | 0.75 |
| $MgCl_2$ | 1.5 | 1.5 | — | — |
| Chelant[16] | — | 0.2 | — | — |
| Chelant[17] | — | — | 0.2 | 0.2 |
| Ammonium chloride | 0.1 | 0.1 | — | — |
| Perfume | 2.5 | 2.5 | 2.5 | 2.5 |
| Water | balance | balance | balance | balance |

[1]N,N-di(canoyloxyethyl)-N-2-hydroxyethyl-N-methyl ammonium methyl sulfate available ex Witco.
[2]N,N-di(canolyl-oxy-ethyl)-N,N-dimethyl ammonium chloride.
[3]N,N-di(canoyloxyethyl)-N-2-hydroxyethyl-N-methyl ammonium chloride.
[4]Ethanol is present from the manufacturing process of the quaternary fabric softener active.
[5]Hexylene glycol is present from the manufacturing process of the quaternary fabric softener active.
[6]Added hexylene glycol.
[7]2,2,4-Trimethyl-1,3-pentanediol (TMPD).
[8]$C_9$–$C_{11}$ alkyl E8 alcohol available as Neodol ® 91-8 ex Shell.
[9]$C_{11}$–$C_{15}$ alkyl E9 alcohol available as Tergitol ® 15S9 ex Union Carbide.
[10]1,1-N-dimethyl-5-N'-methyl-9,9-N"-dimethyl dipropylenetriamine.
[11]1,1-N-dimethyl-9,9-N"-dimethyl dipropylenetriamine.
[12]1,1-N-dihydroxyethyl-7-N'-hydroxyethyl-13,13-N"-dihydroxyethyl dihexylenetriamine (penta-N-hydroxyethyl dihexylenetriamine).

TABLE V-continued

| Ingredients | Weight % | | | |
|---|---|---|---|---|
| | 17 | 18 | 19 | 20 |

[13]Sedipur ® CF803 ex BASF.
[14]Sedipur ® CF104 ex BASF.
[15]Cationically modified polyacrylamides: acrylamide/dimethylamino ethylacrylate methochloride (molar ratio 49:1, K-value 60).
[16]Diethylene triamine pentaacetate.
[17]Tetrakis-(2-hydroxypropyl)ethylenediamine

What is claimed is:

1. A composition providing dye protection benefits to fabric comprising:

A) from 0.05% by weight, of a polymer, copolymer, or mixtures thereof, said polymer or copolymer comprising one or more units selected from the group consisting of:

I) linear polymer units having the formula:

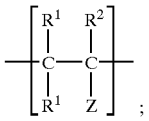

wherein each $R^1$ is independently
a) hydrogen;
b) $C_1$–$C_4$ alkyl;
c) substituted or unsubstituted phenyl;
d) substituted or unsubstituted benzyl;
e) carbocyclic;
f) heterocyclic;
g) and mixtures thereof;
each $R^2$ is independently
a) hydrogen;
b) halogen
c) $C_1$–$C_4$ alkyl;
d) $C_1$–$C_4$ alkoxy;
e) substituted or unsubstituted phenyl;
f) substituted or unsubstituted benzyl;
g) carbocyclic;
h) heterocyclic;
i) and mixtures thereof;
each Z is independently
a) hydrogen;
b) hydroxyl;
c) halogen;
d) $—(CH_2)_mR$;
wherein R is:
i) hydrogen;
ii) hydroxyl
iii) halogen;
iv) nitrilo;
v) $—OR^3$;
vi) $—O(CH_2)_nN(R^3)_2$;
vii) $—O(CH_2)_n+(R^3)_3X^-$;
viii) $—OCO(CH_2)_nN(R^3)_2$;
ix) $—OCO(CH_2)_nN^+(R^3)_3X^-$;
x) $—NHCO(CH_2)_nN(R^3)_2$;
xi) $—NHCO(CH_2)_nN^+(R^3)_3X^-$;
xii) $—(CH_2)_nN(R^3)_2$;
xiii) $—(CH_2)_nN^+(R^3)_3X^-$;
xiv) carbocyclic;
xv) heterocyclic;
xvi) nitrogen heterocycle quaternary ammonium;
xvii) nitrogen heterocycle N-oxide;
xviii) aromatic N-heterocyclic quaternary ammonium;
xix) aromatic N-heterocyclic N-oxide;
xx) —NHCHO;
xxi) or mixtures thereof;
each $R^3$ is independently hydrogen, $C_1$–$C_8$ alkyl, $C_2$–$C_8$ hydroxyalkyl, and mixtures thereof; X is a water soluble anion; the index n is from 0 to 6
e) $—(CH_2)_mCOR'$
wherein R' is
i) $—OR^3$;
ii) $—O(CH_2)_nN(R^3)_2$;
iii) $—O(CH_2)_nN^+(R^3)_3X^-$;
iv) $—NR^3(CH_2)_nN(R^3)_2$;
v) $—NR^3(CH_2)_nN^+(R^3)_3X^-$;
vi) $—(CH_2)_nN(R^3)_2$;
vii) $—(CH_2)_nN^+(R^3)_3X^-$;
viii) or mixtures thereof;
each $R^3$ is independently hydrogen, $C_1$–$C_8$ alkyl, $C_2$–$C_8$ hydroxyalkyl, and mixtures thereof; X is a water soluble anion; the index n is from 0 to 6;
f) and mixtures thereof;
the index m is from 0 to 6;

II) cyclic units derived from cyclically polymerizing monomers having the formula:

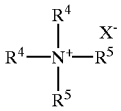

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion; and III) mixtures thereof;
provided said polymer or co-polymer has a net cationic charge;

B) a polyamine selected from the group consisting of N,N'-bis(aminopropyl)-1,3-propylenediamine, N,N'-bis(hydroxyethyl)-N,N'-bis[3-N,N-bis(hydroxyethyl) aminopropyl]-1,3-propylenediamine, N,N'-bis(2-hydroxypropyl)-N,N'-bis[3-N,N-bis(2-hydroxypropyl) aminopropyl]-1,3-propylenediamine, N,N'-bis(2-hydroxybutyl)-N,N'-bis[3-N,N-bis(2-hydroxybutyl) aminopropyl]-1,3-propylenediamine, 5-N-methyl dipropylenetriamine, 1,1-N-dimethyl-5-N'-methyl-9,9-N"-dimethyl dipropylenetriamine, 1,1-N-dimethyl-9,9-N"-dimethyl dipropylenetriamine, and mixtures thereof; and C) the balance carriers and adjunct ingredients.

2. A composition according to claim 1 comprising a co-polymer wherein each $R^1$ is hydrogen, $C_1$–$C_4$ alkyl, phenyl and mixtures thereof and $R^2$ is hydrogen, $C_1$–$C_4$ alkyl, and mixtures thereof.

3. A composition according to claim 2 comprising a co-polymer wherein Z has the formula:

$$—(CH_2)_mCOR'$$

wherein each R' is independently $—O(CH_2)_nN(R^3)_2$; $—O(CH_2)_nN^+(R^3)_3X^-$; $—(CH_2)_nN(R^3)_2$; $—(CH_2)_nN^+(R^3)_3X^-$; and mixtures thereof, m is 0, n is from 2 to 4.

4. A composition according to claim 1 comprising a co-polymer wherein Z has the formula —$CONH_2$, —$CO_2(CH_2)_2N^+(CH_3)_3Cl^-$, and mixtures thereof, wherein the ratio of —$CONH_2$ units to —$CO_2(CH_2)_2N^+(CH_3)_3Cl^-$units is from 9:1 to 1:9.

5. A composition according to claim 2 wherein said composition further comprises from 1% to 80% by weight, of a fabric softening active, said fabric softener active comprises a quaternary ammonium compound having the formula:

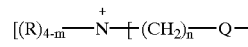

an amine having the formula:

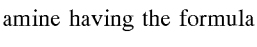

and mixtures thereof; wherein each R is independently $C_1$–$C_6$ alkyl, $C_1$–$C_6$ hydroxyalkyl, benzyl, and mixtures thereof; $R^1$ is $C_1$–$C_{22}$ alkyl, $C_3$–$C_{22}$ alkenyl, and mixtures thereof; Q is a carbonyl moiety having the formula:

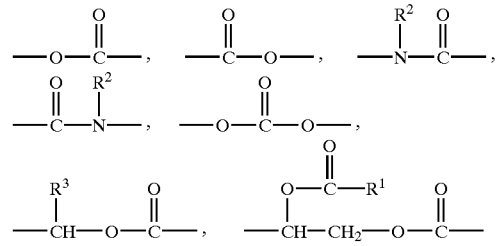

wherein $R^2$ is hydrogen, $C_1$–$C_4$ alkyl, $C_1$–$C_4$ hydroxyalkyl, and mixtures thereof; $R^3$ is hydrogen, $C_1$–$C_4$ alkyl, and mixtures thereof; X is a softener compatible anion; m is from 1 to 3; n is from 1 to 4.

6. A composition according to claim 5, further comprising a crystal growth inhibitor comprising 2-phosphonobutane-1,2,4-tricarboxylic acid and a dye fixing agent comprising dodecyl trimethylammonium chloride.

7. A composition for providing enhanced fabric protection to fabric, said composition comprising:

a) from 0.05% by weight, of a polymer, copolymer, or mixtures thereof, said polymer or copolymer comprising one or more units selected from the group consisting of:

I) linear polymer units having the formula:

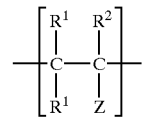

wherein each $R^1$ is independently a) hydrogen;
b) $C_1$–$C_4$ alkyl;
c) substituted or unsubstituted phenyl;
d) substituted or unsubstituted benzyl;
e) carbocyclic;
f) heterocyclic;
g) and mixtures thereof;

each $R^2$ is independently a) hydrogen;
b) halogen
c) $C_1$–$C_4$ alkyl;
d) $C_1$–$C_4$ alkoxy;
e) substituted or unsubstituted phenyl;
f) substituted or unsubstituted benzyl;
g) carbocyclic;
h) heterocyclic;
i) and mixtures thereof;

each Z is independently a) hydrogen;
b) hydroxyl;
c) halogen;
d) —$(CH_2)_mR$;

wherein R is:

i) hydrogen;
ii) hydroxyl
iii) halogen;
iv) nitrilo;
v) —$OR^3$;
vi) —$O(CH_2)_nN(R^3)_2$;
vii) —$O(CH_2)_n+(R^3)_3X^-$;
viii) —$OCO(CH_2)_nN(R^3)_2$;
ix) —$OCO(CH_2)_nN^+(R^3)_3X^-$;
x) —$NHCO(CH_2)_nN(R^3)_2$;
xi) —$NHCO(CH_2)_nN^+(R^3)_3X^-$;
xii) —$(CH_2)_nN(R^3)_2$;
xiii) —$(CH_2)_nN^+(R^3)_3X^-$;
xiv) carbocyclic;
xv) heterocyclic;
xvi) nitrogen heterocycle quaternary ammonium;
xvii) nitrogen heterocycle N-oxide;
xviii) aromatic N-heterocyclic quaternary ammonium;
xix) aromatic N-heterocyclic N-oxide;
xx) —NHCHO;
xxi) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6 e) —$(CH_2)_mCOR'$ wherein R' is i) —$OR^3$;
ii) —$O(CH_2)_nN(R^3)_2$;
iii) —$O(CH_2)_nN^+(R^3)_3X^-$;
iv) —$NR^3(CH_2)_nN(R^3)_2$;
v) —$NR^3(CH_2)_nN^+(R^3)_3X^-$;
vi) —$(CH_2)_nN(R^3)_2$;
vii) —$(CH_2)_nN^+(R^3)_3X^-$;
viii) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6;

f) and mixtures thereof; the index m is from 0 to 6;

II) cyclic units derived from cyclically polymerizing monomers having the formula:

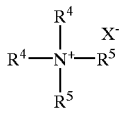

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion; and III) mixtures thereof;

provided said polymer or co-polymer has a net cationic charge;

b) from 0.01% to 50% by weight, of a polyamine, said polyamine is selected from the group consisting of N,N'-bis(aminopropyl)-1,3-propylenediamine; N,N'-bis(hydroxyethyl)-N,N'-bis[3-N,N-bis(hydroxyethyl)aminopropyl]-1,3-propylenediamine; N,N'-bis(2-hydroxypropyl)-N,N'-bis[3-N,N-bis(2-hydroxypropyl)aminopropyl]-1,3-propylenediamine; N,N'-bis(2-hydroxybutyl)-N,N'-bis[3-N,N-bis(2-hydroxybutyl)aminopropyl]-1,3-propylenediamine; 5-N-methyl dipropylenetriamine; 1,1-N-dimethyl-5-N'-methyl-9,9-N"-dimethyl dipropylenetriamine; 1,1-N-dimethyl-9,9-N"-dimethyl dipropylenetriamine; and mixtures thereof;

c) from 0.005% to 1% by weight, of one or more crystal growth inhibitors;

d) from 0.001% to 90% by weight, of one or more dye fixing agents; and e) the balance carriers and adjunct ingredients.

8. A composition providing dye protection benefits to fabric comprising:

a) from 0.05% by weight, of a copolymer having the formula:

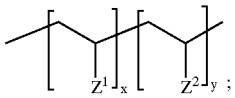

wherein $Z^1$ has the formula:

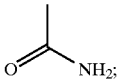

$Z^2$ has the formula:

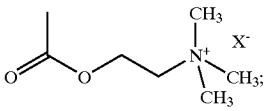

x has the value of from 10 to 100,000; y has the value of from 10 to 100,000; the ratio of x to y is from 9:1 to 1:9;

B) a polyamine selected from the group consisting of N,N'-bis(aminopropyl)-1,3-propylenediamine, N,N'-bis(hydroxyethyl)-N,N'-bis[3-N,N-bis(hydroxyethyl)aminopropyl]-1,3-propylenediamine, N,N'-bis(2-hydroxypropyl)-N,N'-bis[3-N,N-bis(2-hydroxypropyl)aminopropyl]-1,3-propylenediamine, N,N'-bis(2-hydroxybutyl)-N,N'-bis[3-N,N-bis(2-hydroxybutyl)aminopropyl]-1,3-propylenediamine, 5-N-methyl dipropylenetriamine, 1,1-N-dimethyl-5-N'-methyl-9,9-N"-dimethyl dipropylenetriamine, 1,1-N-dimethyl-9,9-N"-dimethyl dipropylenetriamine, and mixtures thereof; and C) the balance carriers and adjunct ingredients.

9. A composition providing dye protection benefits to fabric comprising:

A) from 0.05% by weight, of a polymer, copolymer, or mixtures thereof, said polymer or copolymer comprising one or more units selected from the group consisting of:

I) linear polymer units having the formula:

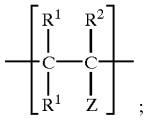

wherein each $R^1$ is independently a) hydrogen;

b) $C_1$–$C_4$ alkyl;

c) substituted or unsubstituted phenyl;

d) substituted or unsubstituted benzyl;

e) carbocyclic;

f) heterocyclic;

g) and mixtures thereof;

each $R^2$ is independently a) hydrogen;

b) halogen c) $C_1$–$C_4$ alkyl;

d) $C_1$–$C_4$ alkoxy;

e) substituted or unsubstituted phenyl;

f) substituted or unsubstituted benzyl;

g) carbocyclic;

h) heterocyclic;

i) and mixtures thereof;

each Z is independently a) hydrogen;

b) hydroxyl;

c) halogen;

d) —$(CH_2)_mR$;

wherein R is:

i) hydrogen;

ii) hydroxyl iii) halogen;

iv) nitrilo;

v) —$OR^3$;

vi) —$O(CH_2)_nN(R^3)_2$;

vii) —$O(CH_2)_nN^+(R^3)_3X^-$;

viii) —$OCO(CH_2)_nN(R^3)_2$;

ix) —$OCO(CH_2)_nN^+(R^3)_3X^-$;

x) —$NHCO(CH_2)_nN(R^3)_2$;

xi) —$NHCO(CH_2)_nN^+(R^3)_3X^-$;

xii) —$(CH_2)_nN(R^3)_2$;

xiii) —$(CH_2)_nN^+(R^3)_3X^-$;

xiv) carbocyclic;

xv) heterocyclic;

xvi) nitrogen heterocycle quaternary ammonium;

xvii) nitrogen heterocycle N-oxide;

xviii) aromatic N-heterocyclic quaternary ammonium;

xix) aromatic N-heterocyclic N-oxide;

xx) —NHCHO;

xxi) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6 e) —$(CH_2)_mCOR'$ wherein R' is i) —$OR^3$;

ii) —$O(CH_2)_nN(R^3)_2$;

iii) —$O(CH_2)_nN^+(R^3)_3X^-$;

iv) —$NR^3(CH_2)_nN(R^3)_2$;

v) —$NR^3(CH_2)_nN^+(R^3)_3X^-$;

vi) —$(CH_2)_nN(R^3)_2$;

vii) —$(CH_2)_nN^+(R_3)_3X^-$;

viii) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6;

f) and mixtures thereof; the index m is from 0 to 6;

II) cyclic units derived from cyclically polymerizing monomers having the formula:

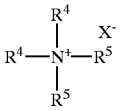

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion; and E) mixtures thereof;

provided said polymer or co-polymer has a net cationic charge;

B) from 0.01% by weight, of a fabric abrasion reducing polymer, said fabric abrasion polymer comprising:

i) at least one monomeric unit comprising an amide moiety;

ii) at least one monomeric unit comprising an N-oxide moiety;

iii) and mixtures thereof;

C) optionally from 1% by weight, of a fabric softening active;

D) optionally less than 15% by weight, of a principal solvent, said principal solvent has a ClogP of from 0.15 to 1;

E) optionally from 0.001% to 90% by weight, of one or more dye fixing agents;

F) optionally from 0.01% to 50% by weight, of one or more cellulose reactive dye fixing agents;

G) optionally from 0.01% to 15% by weight, of a chlorine scavenger;

H) 0.005% to 1% by weight, of one or more crystal growth inhibitors;

I) optionally from 1% to 12% by weight, of one or more liquid carriers;

J) optionally from 0.001% to 1% by weight, of an enzyme;

K) optionally from 0.01% to 8% by weight, of a polyolefin emulsion or suspension;

L) optionally from 0.01% to 0.2% by weight, of a stabilizer;

M) optionally from 1% to 80% by weight, of a cationic surfactant;

N) from 0.01% by weight, of one or more linear or cyclic polyamines which provide bleach protection; and O) the balance carriers and adjunct ingredients.

* * * * *